US005206623A

United States Patent [19]

Rochette et al.

[11] Patent Number: 5,206,623

[45] Date of Patent: Apr. 27, 1993

[54] ELECTRICAL RESISTORS AND METHODS OF MAKING SAME

[75] Inventors: Michel Rochette, Lyons; Paul R. Simon, Nice, both of France

[73] Assignee: Vishay Intertechnology, Inc., Malvern, Pa.

[21] Appl. No.: 695,044

[22] Filed: May 2, 1991

[30] Foreign Application Priority Data

May 9, 1990 [IL] Israel ..... 094340

[51] Int. Cl.[5] ..... H01C 7/00; H01C 7/22; H01C 10/00; H01C 1/02

[52] U.S. Cl. ..... 338/203; 338/295; 338/260; 338/195; 338/307

[58] Field of Search ..... 338/195, 203, 307, 260, 338/295

[56] References Cited

U.S. PATENT DOCUMENTS

| | | |
|---|---|---|
| 2,261,667 | 11/1941 | Stroszeck . |
| 3,657,692 | 4/1972 | Wormser . |
| 3,983,528 | 9/1976 | King . |
| 4,146,867 | 3/1979 | Rolineau et al. . |
| 4,298,856 | 11/1981 | Schuchardt . |
| 4,302,737 | 11/1981 | Kausche . |
| 4,375,056 | 2/1983 | Baxter et al. . |
| 4,386,460 | 6/1983 | Klockow . |
| 4,563,564 | 1/1986 | Ericsen et al. . |
| 4,565,000 | 1/1986 | Brokaw . |
| 4,582,976 | 4/1986 | Merrick . |
| 4,772,774 | 9/1988 | Lejeune . |
| 4,782,320 | 11/1988 | Shier . |
| 4,785,277 | 11/1988 | Yashiro . |
| 4,859,981 | 8/1989 | Peschl . |

FOREIGN PATENT DOCUMENTS

| | | |
|---|---|---|
| 2629334 | 1/1978 | Fed. Rep. of Germany . |
| 2058583 | 5/1971 | France . |
| 661612 | 7/1987 | Switzerland . |
| 732437 | 6/1955 | United Kingdom . |
| 2018036 | 10/1979 | United Kingdom . |
| 1566151 | 4/1980 | United Kingdom . |
| 2054276 | 2/1981 | United Kingdom . |

*Primary Examiner*—Marvin M. Lateef
*Attorney, Agent, or Firm*—M. Lukacher

[57] ABSTRACT

An electrical resistor which is fabricated from traces of resistive material on a substrate of insulating material. The traces are interconnected electrically in series by first links and in parallel by second alternating links, which are connected to different terminals on the substrate. The second links are cut, preferably by laser trimming, so as to select the value of resistance of the resistor by reducing the number of traces connected in parallel and increasing the number of traces connected in series. Where the resistance of each trace is "R", the value of the resistance is adjustable by severing the second links from R/n to nR, where n is the number of traces.

16 Claims, 2 Drawing Sheets

ELECTRICAL RESISTORS AND METHODS OF MAKING SAME

FIELD OF THE INVENTION

The present invention relates to electrical resistors and resistor networks which present selectable values of resistance and also to methods of making same. The invention is especially suitable for providing resistors in thin film or foil form which are laser trimmable to adjust or select the resistance thereof.

BACKGROUND OF THE INVENTION

Laser trimmable planar resistors and resistor networks are well known and are commercially available, from the various vendors including Vishay Intertechnology, Inc. (its Ohmtek subsidiary being located in Niagara Falls, N.Y.) in a wide variety of configurations. In the patent literature there are various patents relating to resistors and resistive networks of this general type. See the following U.S. Pat. Nos.: 4,859,981; 4,782,320; 4,785,277; 4,772,774; 4,582,976; 4,565,000; 4,563,564; 4,386,460; 4,375,056; 4,362,737; 4,298,856; 4,146,867; 3,983,528; 3,657,692; and 2,261,667.

In the manufacture of precision resistors great importance is attached to the means of adjusting their ohmic resistance value to a specific, targeted FIGURE and to do so with precision and consistency. It is desirable to do this over as wide a range of resistance values as possible. Such capability permits the manufacture of otherwise-identical resistors to a semi-finished state in large quantities, with attendant economies of scale. Small quantities of these semi-finished resistors can then be adjusted to a final specific resistance value, as required. The greater the range of adjustability, the fewer the number of semi-finished types which need to be "stocked" to cover the entire range of resistance values which may be required in all possible situations.

This need for adjustability over a wide range is especially acute in the case of resistor networks. These consist of a multiplicity of resistive elements, generally of different value, which are usually employed as voltage dividers. In such cases the effectiveness of the network is highly dependent upon all the individual elements possessing nearly identical performance characteristics. Performance characteristic generally refer to the degree of stability exhibited by the resistor under a variety of adverse physical or chemical stresses either externally or internally generated. Uniformity in this respect can be assured if the resistors in a network are all manufactured in a common production lot. They can then be differentiated solely by resistance value in the adjustment operation. The greater the range of adjustability of a given type, the less the dependence upon different production lots with potentially different performance characteristics.

SUMMARY OF THE INVENTION

It is the principal object of present invention to provide improved adjustable or selectable resistors and resistor networks of extremely high precision and very wide resistance range, and to afford methods for making such resistors and networks.

Briefly described, the invention provides a planar resistor having an insulative substrate with first and second electrical terminals on the substrate. By thin film or foil deposition, a pattern of traces of resistive material are deposited on the substrate and forms a multiplicity of resistive paths interconnected in series by first links which may be of the same resistive material as the traces. A plurality of selectively removable connections (second links) interconnect the traces in parallel between the first and second electrical terminals. These second links extend from the first links, which connect one of the opposite ends of the traces in series, to the first terminal and from others of the first links, which connect the other of the opposite ends of the traces, to the second terminal. To obtain a precise resistance of value between Rn and R/n, where R is the resistance of the traces and n is the number of traces, the second links, are selectively removed thus removing selected parallel connections to provide a desired resistance between the first and second electrical terminals. The multiplicity of resistance traces are arranged in a generally parallel, uniformly wide and mutually spaced relationship. Additionally, in accordance with one embodiment, of the invention, the multiplicity of resistances are of generally identical length. In accordance with another and presently preferred embodiment of the invention, the multiplicity of resistances are of generally differing lengths. In accordance still with another preferred embodiment of the invention, the selectively removable connections are laser removable. Alternatively, connections which are electrically or chemically or mechanically fusible may be employed.

BRIEF DESCRIPTION OF THE DRAWINGS

The present invention will be understood and appreciated more fully from the following detailed description, taken in conjunction with the accompanying drawings in which.

DETAILED DESCRIPTION

Figure 1:
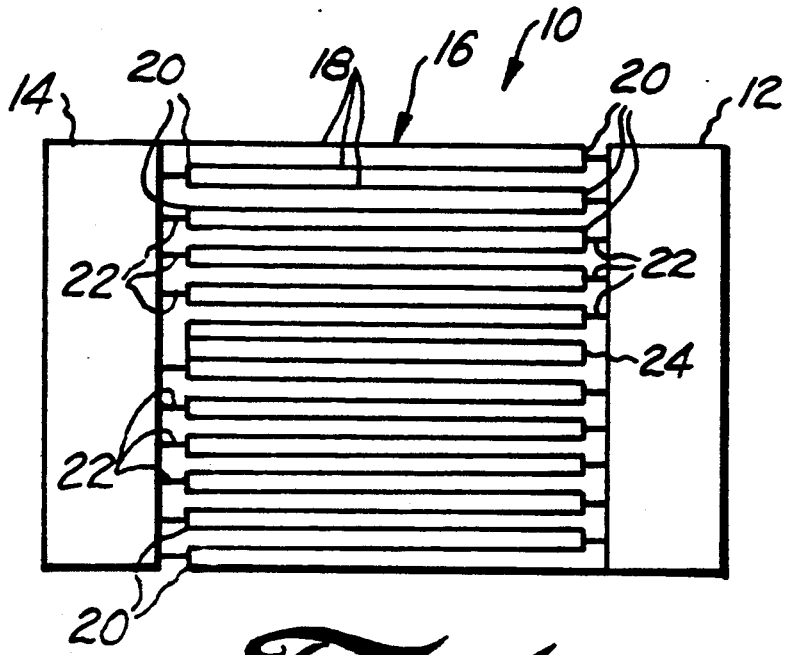
FIG. 1 is an illustration of a resistor constructed and operative in accordance with one embodiment of the invention.

Reference is now made to FIG. 1, which illustrates a planar resistor 10. An insulative substrate is used. It is typically formed of silicon, glass, ceramic or any other suitable dielectric material. Defined on a surface of substrate are first and second electrical terminals 12 and 14, which are preferably formed of a highly conductive material such as aluminum, gold, nickel or platinum.

Disposed between terminals 12 and 14 is a resistive array 16, made from a thin film or foil of a suitable material of precisely known resistance, such as Nichrome or Tantalum Nitride or any other suitable material having good stability over ranges of temperature and time. The resistive array 16, if realized in a thin film, is preferably formed by known technologies of vacuum deposition, such as Joule effect evaporation or cathodic sputtering and photolithographic engraving techniques. If a foil is used, conventional techniques for foil patterning may be employed.

The resistive array 16 has a multiplicity of parallel resistive units (traces or paths), each in the form of a strip 18 and each being of uniform and identical width, thickness, length and separation from its neighbors.

The strips 18 are connected in series one to another between terminals 12 and 14, by means of series connections or links 20 which are typically continuations of the strips 18 and extend from alternate strips between opposite ends thereof. The strips 18 are also each connected in parallel between terminals 12 and 14 by means of selectively fusible parallel connections (second links) 22, which are also typically defined as continuations of strips 18 and extend from connections 20. Connections 22 are preferably laser fusible in accordance with conventional laser fusing techniques described in the prior art mentioned hereinabove, which are incorporated herein by reference, and using apparatus of the general type commercially available from Chicago Laser and ESI Corporation of Portland, OR, USA.

In accordance with the present invention, selective fusing of one or more respective parallel connections 22 produces an open circuit thereat, enabling the resistance of the array to be increased in a step-wise fashion, while maintaining other characteristics of the resistor. Additionally, in accordance with an embodiment of the present invention, an additional resistive top hat element 24 may be provided as part of the resistor pattern and which may be cut by conventional laser trimming techniques in such a manner as to provide continuous, and thereby more precise, adjustment of the resistance. The cut may be made along the length of the element 24 through the connecting link 22 starting at the end of the element 24 at the left hand side of the FIG.

For the configuration of FIG. 1, including n resistive strips of individual resistance R, there are a large number of different combinations of fusing patterns, which can provide a multiplicity of discrete different resistance values. When none of the parallel connections (second links) are cut the overall resistance is minimal, R min=R/n. When all of the parallel connections 22 are cut, this resistance is maximal at R max=nR. There are $2^{2n}$ different series and parallel combinations, which can provide theoretically $2^{2n}$ different resistance values between R max and R min. In practice, less than $2^{2n}$ different resistance values are provided due to redundancy or impracticality. Typically, the number of strips or resistance elements n is between 5 and 30, although n may be between 2 and the number of resistance elements (strips) which can be accommodated on a substrate. To obtain values intermediate between the discrete values obtained by fusing links, additional variations in resistance can be obtained by trimming the top hat element 24. This can be done by making and extending a length wise cut therethrough so as to provide a continuous increase in resistance value.

Figure 2:
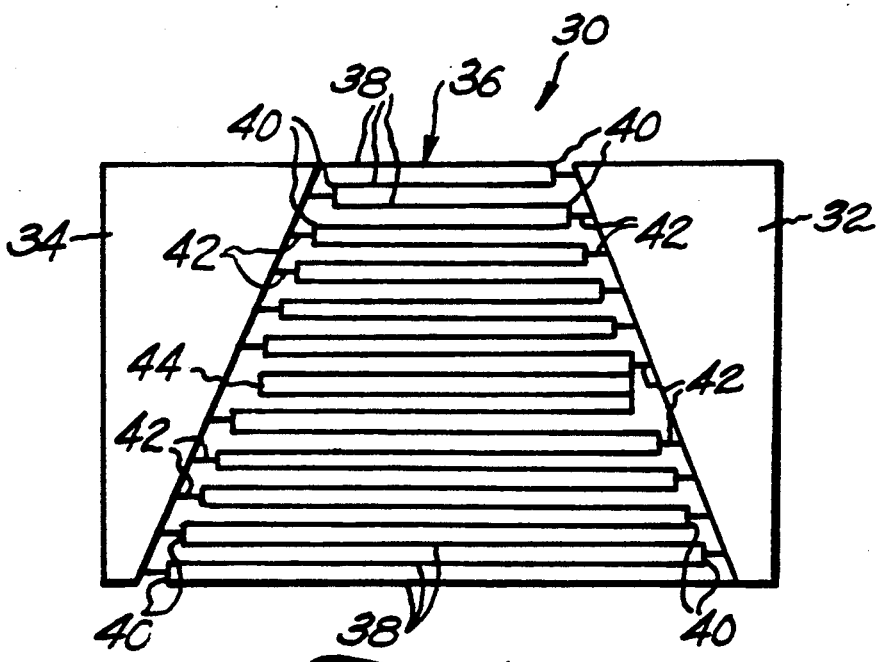
FIG. 2 is an illustration of a resistor constructed and operative in accordance with the presently preferred embodiment of the invention.

Reference is now made to FIG. 2 which illustrates a resistor 30 constructed and operative in accordance with the presently preferred embodiment of the present invention. It may be made in a manner similar to the embodiment of FIG. 1. Disposed between terminals 32 and 34 is a resistive array 36 with series connections (first links) 40 and parallel connections (second links) 42 to terminals 32 and 34. The array 36 is made up of a plurality of parallel resistive units (path or traces), each in the form of a strip 38 and each being of precisely uniform and identical width, thickness and separation from its neighbor, but of different length. The series connections 40 have links 42 to the terminals 32 and 34 which are selectively fused (cut) to incrementally change the resistance value. Top hat 44 is for the same function as top hat 24 FIG. 1. The top hat 44 is cut lengthwise from the right hand end connection to make an analog adjustment in the incremental value selected by cutting the links 42.

As compared with the embodiment of FIG. 1, the embodiment of FIG. 2, in which the lengths of resistors elements 38 differ from each other, provides a greater amount of redundancy for each given adjusted resistance value. This increased redundancy enables connection fusing patterns to be selected having relatively high ratios of heat disspation surface to substrate surface, while limiting temperature gradients between parts of the resistive array.

Figure 3:
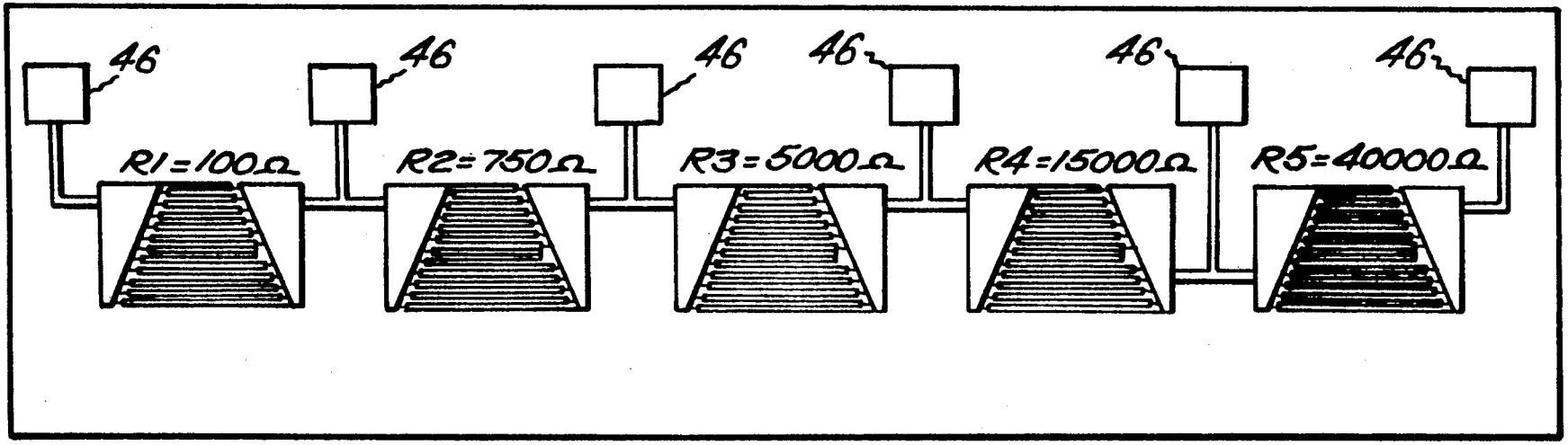
FIG. 3 is an illustration of a resistor network of five different resistor configurations realized by fusing different connections 22 of the general configuration shown in FIG. 2, the network being typically formed on a single substrate.

Reference is now made to FIG. 3 which illustrates a resistor network including five generally identical resistors of the type illustrated in FIG. 2, where n=21 and the resistance value of the strips is a nominal 2,000 ohms. The resistors are each formed, each with a different fused connection pattern, so as to have five different final resistance values. It is seen that in this example, the resistance realized ranged from 95 ohms, when all of the connections 42 are left intact, to 42,000 ohms, when all of the connections 42 are fused except for the links at either end of the chain. In FIG. 3 the five resistors are shown interconnected and having output terminals 46.

While five resistors are shown, a greater or lesser number of resistors of any suitable configuration and connection fusing pattern, may be combined into a resistor network either by being formed integrally on a single substrate, such as a wafer, or by wire bonding between physically independent elements. Without the availability of a single resistor pattern which is adjustable over a very wide resistance range individual resistors would have to be selected from, different production lots conventionally made with individual patterns of very limited resistance range. This would adversely affect both the economics of the network fabrication process and the operational performance of the network. In many applications the circuit function is dependent upon precisely fixing, and maintaining, the ratio of various resistance values, one to another. To accomplish this it is important that any changes in resistance value which take place subsequent to initial fixing be as uniform as possible among all the elements. This can most easily be achieved by arranging that all the resistors in a given network are derived from the same production lot.

In the foregoing description it will be apparent that improved resistance elements which are of selectably adjustable value of resistance or individual resistors or in networks have been described. Variations and modifications thereof within the scope of the invention will undoubtedly become apparent to those skilled in the art. Accordingly, the foregoing description should be taken as illustrative and not in a limiting sense.

What is claimed is:

1. A resistor comprising an insulative substrate, first and second conductive terminals on the substrate, a multiplicity (n) of resistance units connected in series, by interconnecting first links joining alternate ones of said units at opposite ends thereof, second links providing selectively removable connections which are shorter than said units, and join said first links to said first and second terminals alternately, so that with all the second links intact the collective resistance of the units is the sum of all the units connected in parallel (R/n) and with all the second links removed, leaving only the first links, the collective resistance is the sum of all the lengths in series (nR), which collective resistance is adjustable in steps.

2. A resistor according to claim 1 and wherein each of the units has a path of resistive material and all units are paths of resistive material generally identical in length.

3. A resistor according to claim 1 and wherein each of the units is a path of resistive material, said units are paths of resistive material generally different in length.

4. A resistor according to claim 1 wherein said units are paths of resistive material, one of said paths being much wider than the others and being severable along the length thereof to permit adjustment of resistance value of said resistor between said steps continuously.

5. A resistor according to claim 1, wherein n is from 5 to 30, providing an overall range of resistance (ratio of the maximum to minimum values attainable) of n squared, which is equal to 400 when n=20.

6. A resistor network have a group of identical resistors as set forth in claim 1, adapted to be interconnected between their said terminals to form a network, and wherein each resistor in the group is initially of minimum resistance value R/n and is adjustable to a desired value up to a maximum value of nR by selective severance of said second links thereof; said resistors being disposed in on a surface of a common substrate, said resistors having identical characteristics except for their resistance value obtained by means of the severance of said second links, whereby all said resistors can initially have minimum resistance value and can provide said network of said resistors each of which can be adjusted to a different resistance value.

7. A resistor according to claim 1 wherein said units as selected from the group consisting of thin film deposited on and foil attached to said substrate.

8. A resistor network according to claim 6 wherein said units of each resistor of said network is selected from the group consisting of thin film deposited onto said surface of said substrate and foil traces attached to said substrate.

9. A method for providing a resistor of precise resistance of selectable value including the steps of:

providing an insulative substrate, forming first and second electrical terminals on the substrate, forming a multiplicity of resistances on the substrate which are joined in series, forming a plurality of selectably removable connections interconnecting adjacent ones of the multiplicity of resistances in parallel between the first and second electrical terminals; and selectively removing selected ones of the connections to provide a desired resistance between the first and second electrical terminals.

10. The method according to claim 9 wherein said step of selectively removing comprises the step of laser fusing.

11. The method according to claim 9 wherein said step of forming said multiplicity of resistances is carried out b forming substantially all of said multiplicity of resistances as traces of generally identical width and thickness.

12. The method according to claim 9 wherein said step of forming said multiplicity of resistances is carried out by forming the multiplicity of resistances as traces of generally identical length.

13. The method according to claim 9 wherein said step of forming said multiplicity of resistances is carried out by forming the multiplicity of resistances as traces of generally different lengths.

14. The method according to claim 9 wherein all of said steps are carried out to form a plurality of said resistors, including a first and a last of said resistors in said plurality integrally with said substrate, and further comprising the step of interconnecting said first and second terminals of said plurality of resistors, except for the first terminal of the first resistor and the second terminal of the last resistor, to provide a network of said plurality of resistors.

15. The resistor according to claim 3 wherein said paths of different length increase progressively in length to define a generally trapezoidal array.

16. The method according to claim 13 wherein said step of forming said multiplicity of resistances is carried out to increase the lengths thereof progressively thereby forming a generally trapezoidal array.

* * * * *